US010086601B2

(12) United States Patent
Luo

(10) Patent No.: US 10,086,601 B2
(45) Date of Patent: Oct. 2, 2018

(54) LETTERING APPARATUS AND LETTERING METHOD FOR BEER BARREL

(71) Applicant: NINGBO MASTER DRAFT BEER KEG EQUIPMENT CO., LIMITED, Ningbo, Zhejiang (CN)

(72) Inventor: Bangcai Luo, Ningbo (CN)

(73) Assignee: NINGBO MASTER DRAFT BEER KEG EQUIPMENT CO., LIMITED (CN)

( * ) Notice: Subject to any disclaimer, the term of this patent is extended or adjusted under 35 U.S.C. 154(b) by 0 days.

(21) Appl. No.: 15/263,692

(22) Filed: Sep. 13, 2016

(65) Prior Publication Data

US 2016/0375678 A1 Dec. 29, 2016

Related U.S. Application Data

(63) Continuation-in-part of application No. PCT/CN2014/007768, filed on May 16, 2014.

(30) Foreign Application Priority Data

Mar. 13, 2014 (CN) ..... 2014 1 0092237
Mar. 13, 2014 (CN) ..... 2014 2 0115113 U
May 10, 2016 (CN) ..... 2016 1 0303861

(51) Int. Cl.
*B41K 3/36* (2006.01)
*B41F 17/00* (2006.01)
(Continued)

(52) U.S. Cl.
CPC ..... *B41F 17/006* (2013.01); *B41F 19/02* (2013.01); *B65D 1/16* (2013.01); *B65D 85/72* (2013.01)

(58) Field of Classification Search
CPC ..... B41F 17/006; B41F 17/108; B41F 17/18; B41F 17/22; B41F 17/28; B41F 17/30;
(Continued)

(56) References Cited

U.S. PATENT DOCUMENTS 3,076,358 A * 2/1963 Paper ..... B21H 3/022 40/629

FOREIGN PATENT DOCUMENTS

| | | | | |
|---|---|---|---|---|
| CN | 101734028 | * 12/2009 | ..... | B41K 3/36 |
| CN | 102602206 | * 1/2014 | ..... | B44B 3/04 |
| DE | 3802438 | * 1/1988 | ..... | B44B 5/00 |

* cited by examiner

*Primary Examiner* — Matthew G Marini
*Assistant Examiner* — Marissa Ferguson Samreth
(74) *Attorney, Agent, or Firm* — Gearhart Law LLC

(57) ABSTRACT

A lettering apparatus and a lettering method for a beer barrel are provided. The lettering apparatus includes a worktable, a hydraulic push device installed on the worktable, a first lettering device, and a second lettering device. The second lettering device includes a rotatory disk seat with the Z-axis as its axis. The rotatory disk seat is adapted to install a cask thereon. A circumferential surface of the rotatory disk seat is provided with an inner mold for lettering on an inner side of the cask. The first lettering device includes a connecting frame. The connecting frame is movable linearly along the Y-axis. The connecting frame is provided with an outer mold for lettering on an outer side of the cask. The hydraulic push device controls the outer mold of the connecting frame to move linearly along the X-axis for the outer mold and the inner mold to letter on a side wall of the cask.

20 Claims, 15 Drawing Sheets

(51) Int. Cl.

| | |
|---|---|
| ***B41F 19/02*** | (2006.01) |
| ***B65D 1/16*** | (2006.01) |
| ***B65D 85/72*** | (2006.01) |

(58) Field of Classification Search
CPC ..... B41F 19/02; B44B 5/0028; B41C 1/08;
B65D 1/16; B65D 1/165
See application file for complete search history.

LETTERING APPARATUS AND LETTERING METHOD FOR BEER BARREL

CLAIM OF PRIORITY

This application is a United States continuation-in-part patent application claiming benefit of Chinese Patent Applications No. CN 2016103038616, filed on May 10, 2016, and PCT Application No. PCT/CN 2014/077688, filed on May 16, 2014, which claims priority to Chinese Patent Applications No. CN 2014100922377, filed on Mar. 13, 2014 and CN 201420115113.1, filed on Mar. 13, 2014, the disclosures of which are incorporated herein in their entirety by reference.

FIELD OF THE INVENTION

The present invention relates to a lettering field, and more particularly to a lettering apparatus and a lettering method for a beer barrel.

BACKGROUND OF THE INVENTION

A beer barrel is a common container for containing beer. In order to ensure the strength of the beer barrel, while reducing weight and rust, the beer barrel is made of a stainless steel material. For easy identification, the body of the beer barrel is embossed with the related label information. In the prior art, the label information is first embossed on the raw material (such as a stainless steel plate), and then the raw material embossed with the label information is stretched and welded to form a barrel body. This method has the following drawbacks:

1. During stretch forming and welding, there may be defective semi-products caused by error operations or other reasons. The prior embossing step is useless accordingly. This increases additional processing cost and processing time.

2. During production, some letters of labels are identical, and some are different. But all letters of a label are made as a whole by a model. Because the letters are not exactly the same, it is necessary to manufacture various matrix molds for different labels. Therefore, the cost and time of manufacturing matrix molds are increased accordingly.

SUMMARY OF THE INVENTION

In view of the problems of the prior art, the primary object of the present invention is to provide a lettering apparatus for a beer barrel, which can avoid a waste of semi-finished products if the process of lettering is performed before stretch forming and welding and the stretch forming and welding cause defective products.

According to one aspect of the present invention, a lettering apparatus for a beer barrel is provided. The lettering apparatus comprises a worktable, a hydraulic push device installed on the worktable, a first lettering device, and a second lettering device. The second lettering device comprises a rotatory disk seat with the Z-axis as its axis. The rotatory disk seat is adapted to install a cask thereon. A circumferential surface of the rotatory disk seat is provided with an inner mold for lettering on an inner side of the cask. The first lettering device comprises a connecting frame. The connecting frame is movable linearly along the Y-axis. The connecting frame is provided with an outer mold for lettering on an outer side of the cask. The hydraulic push device controls the outer mold of the connecting frame to move linearly along the X-axis for the outer mold and the inner mold to emboss on a side wall of the cask.

Preferably, the hydraulic push device comprises a hydraulic cylinder, a hydraulic cylinder installation frame, a first guide rail, and a movable frame. The hydraulic cylinder is installed on the worktable through the hydraulic cylinder installation frame. The first guide rail is disposed on top of the worktable. The movable frame is installed on the first guide rail and moved linearly along the X-axis through a push rod of the hydraulic cylinder.

Preferably, the first lettering device further comprises a Y-axis servo motor, a screw rod, and a second guide rail. The Y-axis servo motor, the screw rod, and the second guide rail are all installed on the movable frame. The Y-axis servo motor brings the screw rod to turn. One end of the connecting frame is installed on the second guide rail to slide along the Y-axis. Another end of the connecting frame is threadedly connected with the screw rod.

Preferably, the second lettering device further comprises a Z-axis servo motor and a bearing. The bearing is installed on the worktable. The rotatory disk seat is installed in the bearing. The Z-axis servo motor is disposed at the bottom of the worktable and brings the rotatory disk seat to turn on the bearing with the Z-axis as its axis.

Preferably, the inner mold and the outer mold each comprise at least one matrix. The matrix of the inner mold and the matrix of the outer mold are matched with each other to form a matrix assembly for embossing a single letter. The matrixes of the outer mold and the inner mold are installed on a Y-axis surface of the connecting frame and the circumferential surface of the rotatory disk seat, respectively. The matrix of the connecting frame is moved along the X-axis toward the matrix of the rotatory disk seat to complete embossing of the matrix assembly.

Preferably, the circumferential surface of the rotatory disk seat and the Y-axis surface of the connecting frame are each formed with at least one dovetail recess having the same size. The matrix of the inner mold and the matrix of the outer mold have the same size. The back of the matrix of the inner mold and the back of the matrix of the outer mold are engaged in the dovetail recesses of the rotatory disk seat and the connecting frame, such that the matrix of the inner mold and the matrix of the outer mold are installed on the circumferential surface of the rotatory disk seat and the Y-axis surface of the connecting frame, respectively.

Preferably, when the X-axis is aligned with the diameter of the rotatory disk seat, the matrix of the connecting frame and the matrix of the rotatory disk seat are to emboss normally.

Preferably, the lettering apparatus for a beer barrel further comprises a cask drive mechanism. The cask drive mechanism comprises a three-detent positioning clamp used to position and control the cask to rotate axially and independently. The three-detent positioning clamp and the rotatory disk seat are coaxial. The three-detent positioning clamp is axially movable.

Preferably, the cask drive mechanism further comprises a third guide rail, a fourth guide rail, a placement board, a Z-axis cylinder, a first cylinder, and a lift mechanism. The third guide rail and the fourth guide rail are disposed on the worktable and the lift mechanism respectively and parallel to the Z-axis. The placement board is mounted on the third guide rail and moved linearly along the third guide rail through the Z-axis cylinder. The three-detent positioning clamp is mounted on the fourth guide rail and moved linearly along the fourth guide rail through the first cylinder.

The lift mechanism is installed on the placement board to bring the three-detent positioning clamp to ascend and descend.

Preferably, the three-detent positioning clamp comprises an engaging disk installation frame, an engaging disk servo motor, and a three-detent engaging disk. The three-detent engaging disk and the rotatory disk seat are coaxial. The three-detent engaging disk is installed on the fourth guide rail through the engaging disk installation frame to be rotated axially. The back of the three-detent engaging disk is provided with a gear. The three-detent engaging disk and the gear are coaxial. The engaging disk servo motor is fixedly installed on the engaging disk installation frame and meshes with the gear, enabling the cask to be independently rotated relative to the rotatory disk seat. The first cylinder controls the engaging disk installation frame to slide along the fourth guide rail.

Preferably, the lift mechanism comprises a lift cylinder, a lift board, a sleeve rod, and a guide rod. The sleeve rod and the guide rod are disposed at the periphery of the placement board. The lift cylinder and the sleeve rod are fixedly installed on the placement board. The guide rod is slidably inserted in the sleeve rod. The top of the guide rod is fixedly connected to the lift board. A lift rod of the lift cylinder brings the lift board to ascend and descend. The fourth guide rail is installed on the lift board.

Preferably, the lettering apparatus for a beer barrel further comprising a cask placement mechanism. The cask placement mechanism comprises two support seat assemblies. Each support seat assembly comprises a slide seat, an adjustment mechanism, a positioning board installed on the lift board, and a pair of rollers disposed symmetrically at left and right sides of the slide seat. Outer circumferential surfaces of the rollers are in contact with the outer side of the cask. The left and right sides of the slide seat are installed on the fourth guide rail and slides linearly along the fourth guide rail. The positioning board is located on top of the slide seat and has a plurality of adjustment holes arranged along Z-axis. The slide seat and the adjustment holes are connected through the adjustment mechanism.

Preferably, the slide seat has a slotted hole. The slotted hole and the adjustment holes are fixedly connected through the adjustment mechanism.

Preferably, the lettering apparatus for a beer barrel further comprises a tightening mechanism. The tightening mechanism comprises a slide block, a second cylinder, a fifth guide rail, and a pair of tightening blocks disposed symmetrically at left and right sides of the slide block. The fifth guide rail and the second cylinder are installed on the hydraulic cylinder installation frame. The fifth guide rail is parallel to the X-axis. The slide block is installed on the fifth guide rail and pushed by the second cylinder to slide linearly along the fifth guide rail. One end of the cask is engaged with the three-detent engaging disk. Another end of the cask leans against the tightening block.

Preferably, the tightening block leans against a middle portion of the cask.

Preferably, the tightening block is made of nylon.

According to another aspect of the present invention, a lettering method for a beer barrel is provided. The method comprises the steps of:

1). installing and arranging multiple pairs of matrix assemblies on a Y-axis surface of a connecting frame and a circumferential surface of a rotatory disk seat respectively corresponding to letters of a label;

2). placing a cask which has been stretched and welded on the rotatory disk seat, enabling an inner side of the cask to correspond in position to matrixes of convex mold configurations of the matrix assemblies and an outer side of the cask to correspond in position to matrixes of concave mold configurations of the matrix assemblies, the matrix of the first concave mold configuration and the matrix of the first convex mold configuration being at an embossing position;

3). moving the connecting frame along the X-axis for the matrix of the first concave configuration to get contact with a side wall of the cask and mate with the matrix of the first convex mold configuration to emboss the first letter of the label, and then moving the connecting frame reversely along the X-axis for the matrix of the first concave configuration to disengage from the matrix of the first convex mold configuration;

4). after disengagement, moving the connecting frame along the Y-axis for the matrix of the next concave mold configuration to be moved to the embossing position, turning the rotatory disk seat along the Z-axis for the cask and the matrix of the next convex mold configuration to be rotated to the embossing position for embossing through the step 3; and 5). embossing the other letters of the label to complete the label through the step 4.

Preferably, in the step 1, if the letters and the order of the matrix assemblies in use are the same as the previous installed matrix assemblies, the previous installed matrix assemblies are remained and the other different letters of the matrix assemblies are changed.

Preferably, when the matrix of the concave mold configuration is moved along the X-axis to disengage from the matrix of the convex mold configuration, the side wall of the cask is still engaged on the matrix of the convex mold configuration, the rotatory disk seat brings the cask to rotate along the Z-axis.

According to a further aspect of the present invention, a lettering method for a beer barrel is provided. The method comprises the steps of:

1). installing and arranging multiple pairs of matrix assemblies on a Y-axis surface of a connecting frame and a circumferential surface of a rotatory disk seat, wherein the Y-axis surface of the connecting frame is provided with matrixes of concave mold configurations, and the circumferential surface of the rotatory disk seat is provided with matrixes of convex mold configurations;

2). positioning one end of a cask which has been stretched and welded through a three-detent engaging disk, the cask being moved to an embossing position, enabling an inner side of the cask to correspond in position to the matrixes of the convex mold configurations and an outer side of the cask to correspond in position to the matrixes of the concave mold configurations;

3). embossing the first letter of a label, wherein the corresponding matrix of the concave mold configuration of the connecting frame is moved to the embossing position, the corresponding matrix of the convex mold configuration of the rotatory disk seat is rotated along the Z-axis to the embossing position, the matrix of the concave mold configuration is moved along the X-axis through the hydraulic cylinder to match with the corresponding matrix of the convex mold configuration to perform embossing, after embossing, the matrix of the concave mold configuration is homed along the X-axis, the cask is lifted up through a lift cylinder to separate from the matrix of the convex mold configuration;

4). embossing the next letter of the label, wherein the cask is rotated an angle by the three-detent engaging disk, and then the step 3 is performed; and 5). embossing the other letters of the label to complete embossing of the label through the step 4.

Preferably, the cask, the connecting frame, and the rotatory disk seat are separately controlled.

Preferably, in the step 2 the cask is transversely disposed on a cask placement mechanism, the three-detent engaging disk is moved toward the cask for two ends of the cask to hold against a tightening mechanism and the three-detent engaging disk respectively, the cask is positioned by the three-detent engaging disk, the tightening mechanism is homed along the X-axis, and the cask is moved to the embossing position.

The lettering apparatus and method for a beer barrel of the present invention have the following advantages.

1. Through the inner mold and the outer mold provided on the rotatory disk and the connecting frame, the cask which has been stretched and welded is placed on the rotatory disk seat of the apparatus to be embossed by the outer and inner molds, such that the side wall of the cask can be embossed with a label. This can avoid a waste of semi-finished products if the process of lettering is performed before stretch forming and welding and the stretch forming and welding cause defective products. Thus, the manufacture cost and time of products can be decreased.

2. The matrix of a single inner mold mates with the matrix of a single outer mold to form a matrix assembly for embossing a single letter. The matrixes are installed on the connecting frame and the rotatory disk seat, respectively, such that the matrix molds of the label can be separated into multiple matrix assemblies of the letters. During production, some letters of labels are identical, and some are different. When it is necessary to change the matrixes, only the different matrix assemblies relative to the previous matrix assemblies are required to be changed and the order of the matrix assemblies is adjusted. The matrix assemblies of the same letters are remained. The present invention achieves the versatility and interchangeability for the same matrix assemblies of different labels and saves the time to exchange the molds. There is no need to manufacture various letter molds for different labels so as to save the cost and time of manufacturing molds.

3. Through the servo motor, the matrixes can be moved and rotated more precisely.

4. When the connecting frame is moved along the X-axis for the matrix of the concave mold configuration to disengage from the matrix of the convex mold configuration, the side wall of the cask is still engaged on the matrix of the convex mold configuration. The rotatory disk seat brings the cask to rotate along the Z-axis. The rotatory disk can be used for different sizes of casks. There is no need to provide multiple rotatory disks. Thus, the cost to manufacture the apparatus for lettering on the beer barrel is lowered.

5. The first lettering device, the second lettering device, and the cask drive mechanism of the present invention can be controlled separately. The rotatory disk seat and the connecting frame can be provided with plenty of matrixes. When the letters to be embossed are input, the rotatory disk seat and the connecting frame will be automatically moved to the embossing position to save the time for changing the letter matrixes. It is very convenient for embossing serial numbers.

6. Through the cask drive mechanism, the cask can be turned on the rotatory disk seat so as to adjust the spacing between two adjacent letters on the cask, such that the letters to be embossed on the cask can be adjusted.

DESCRIPTION OF THE PREFERRED EMBODIMENTS

Figure 1:
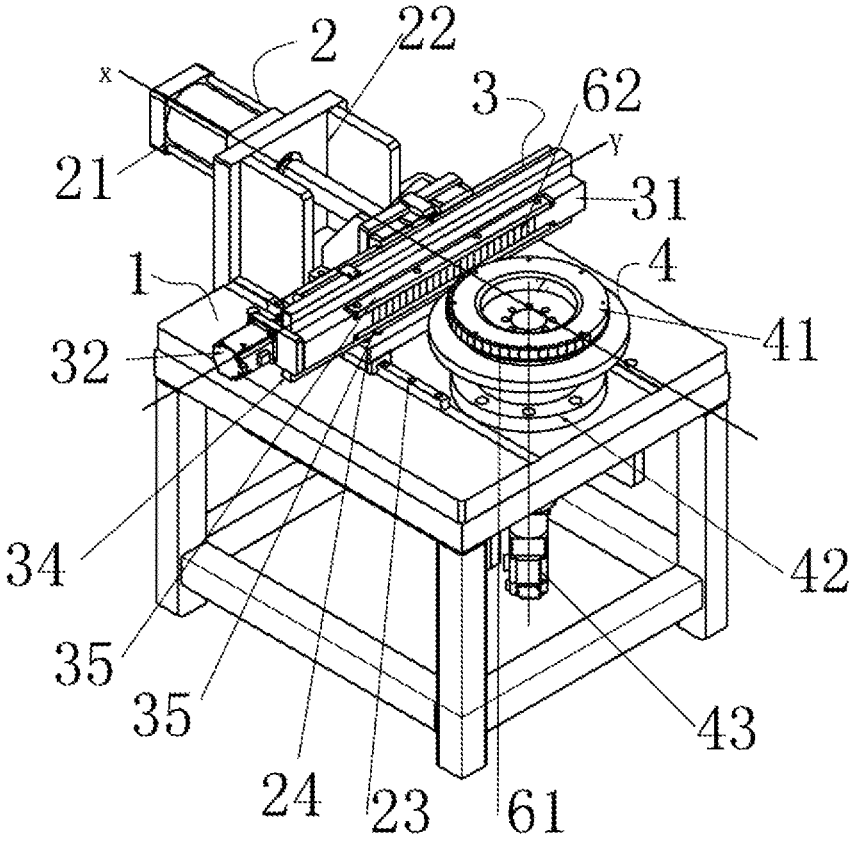
FIG. 1 is a perspective view of a vertical-type lettering apparatus for a beer barrel of the present invention.
Figure 2:
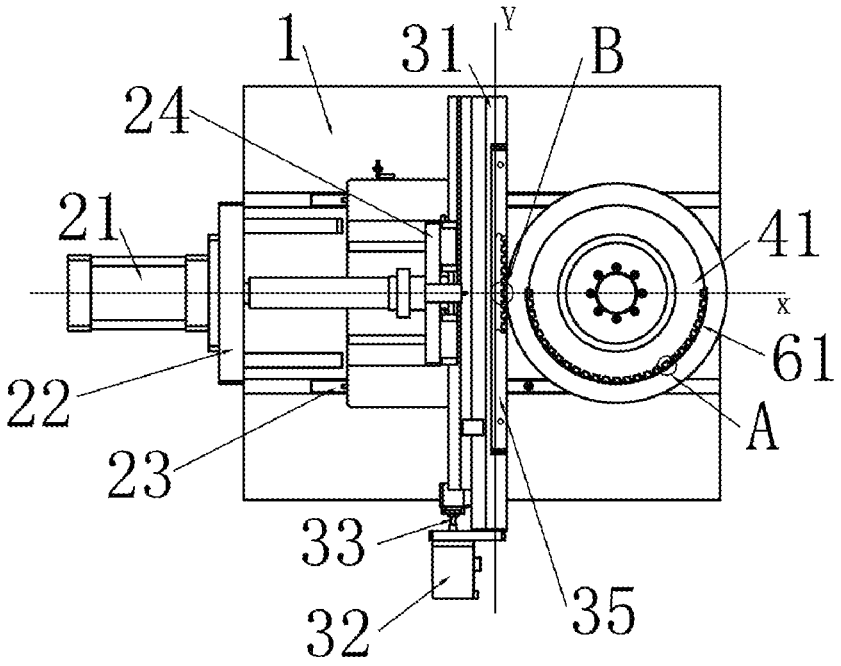
FIG. 2 is a top view of the vertical-type lettering apparatus for a beer barrel of the present invention.
Figure 3:
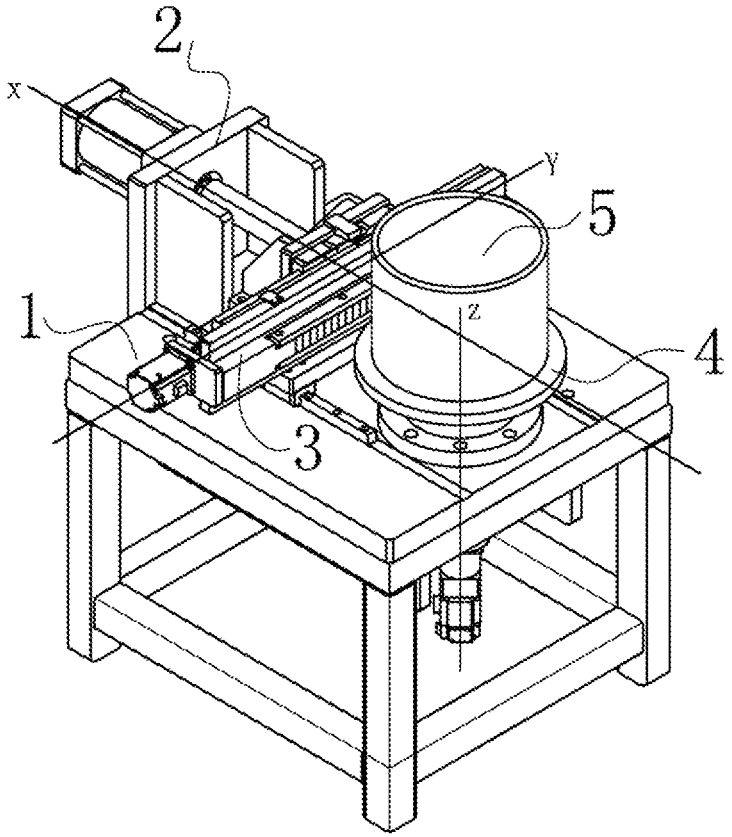
FIG. 3 is a perspective view of FIG. 1 in cooperation with a cask.
Figure 4:
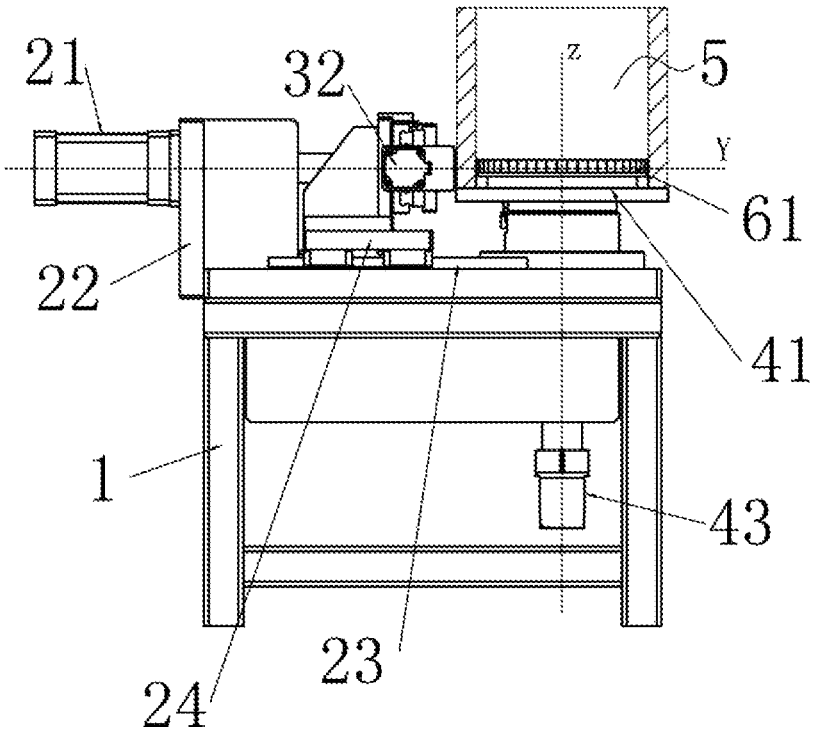
FIG. 4 is a front view of FIG. 3.
Figure 5:
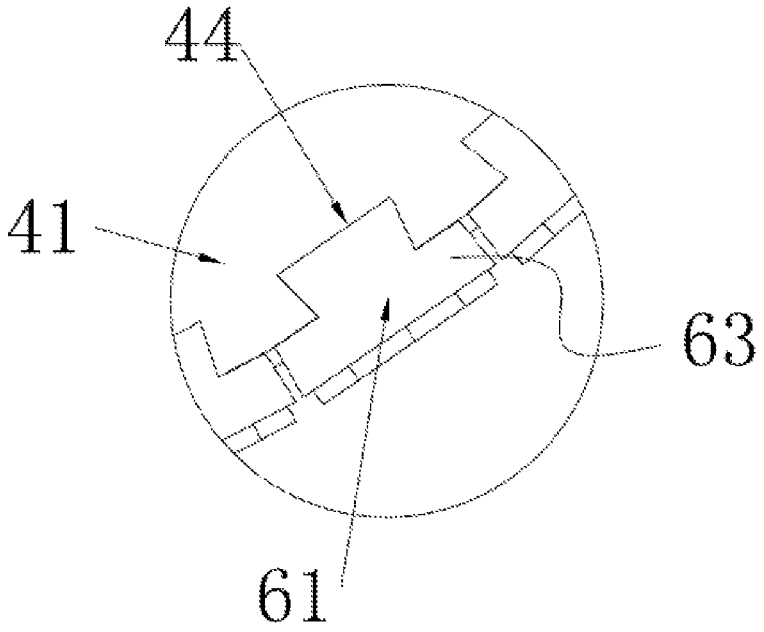
FIG. 5 is an enlarged view of circle A of FIG. 2.
Figure 6:
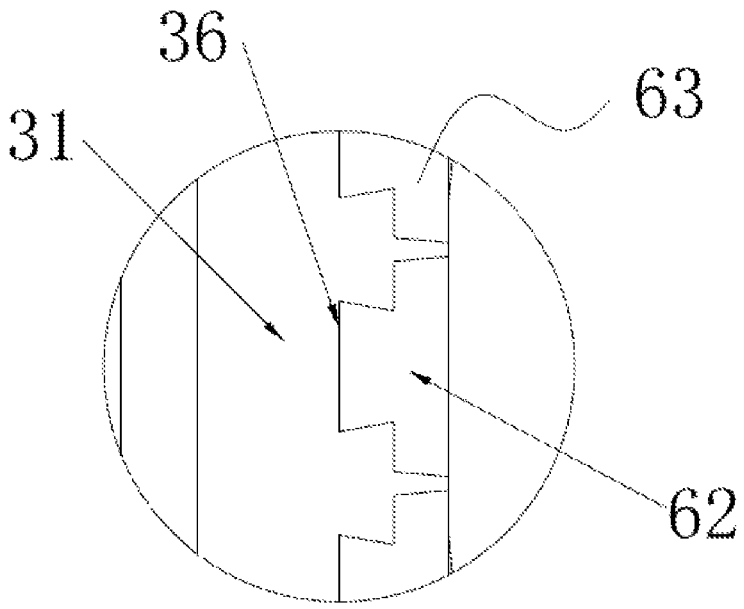
FIG. 6 is an enlarged view of circle B of FIG. 2.
Figure 7:
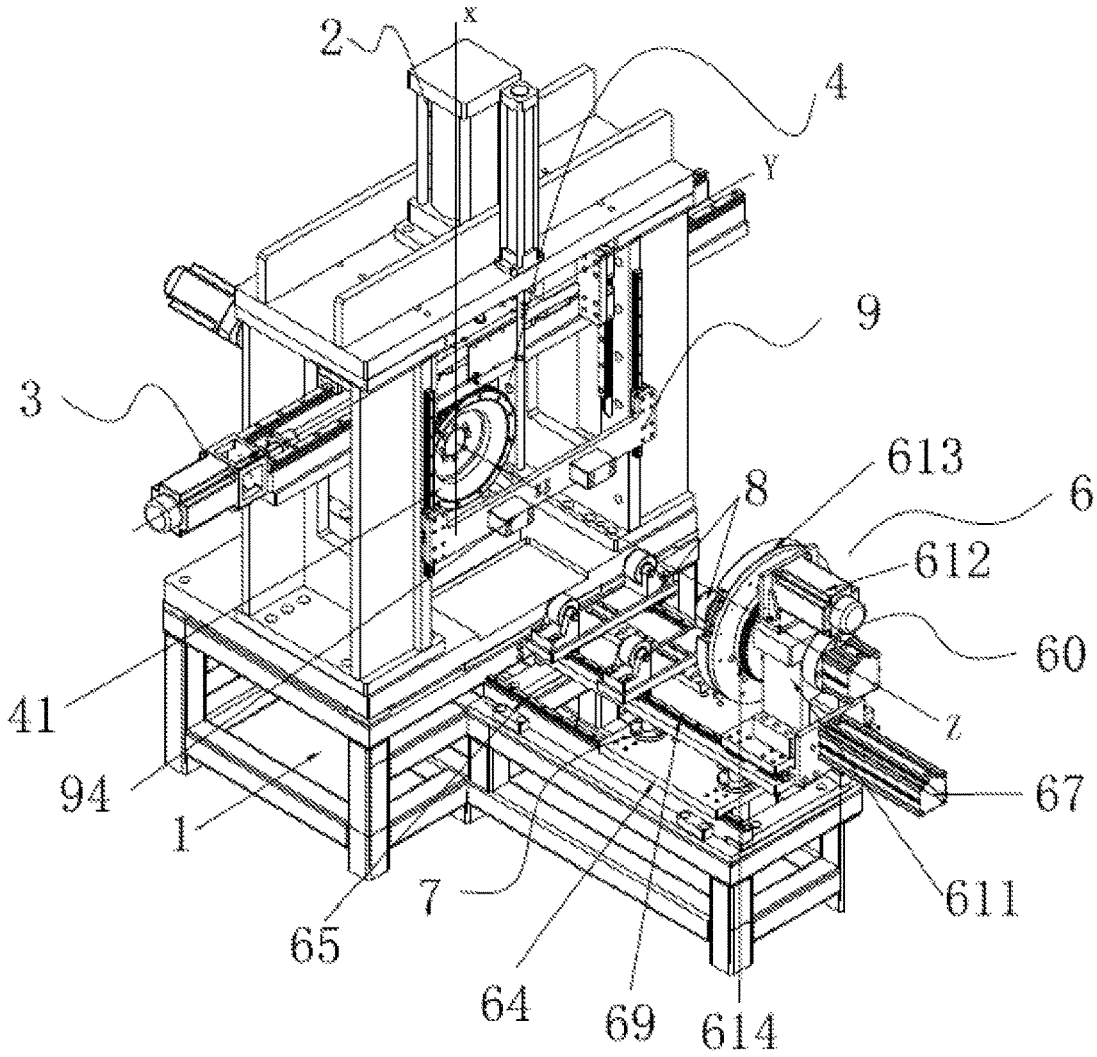
FIG. 7 is a perspective view of a horizontal-type lettering apparatus for a beer barrel of the present invention.

Advantages and features of the inventive concept and methods of accomplishing the same may be understood more readily by reference to the following detailed description of embodiments and the accompanying drawings. The inventive concept may, however, be embodied in many different forms and should not be construed as being limited to the embodiments set forth herein.

As shown in FIG. 1 to FIG. 4, a vertical-type lettering apparatus for a beer barrel in accordance with a first embodiment of the present invention comprises a worktable 1, a hydraulic push device 2 installed on the worktable 1, a first lettering device 3, and a second lettering device 4. The hydraulic push device 2 comprises a hydraulic cylinder 21, a hydraulic cylinder installation frame 22, a first guide rail 23, and a movable frame 24. The hydraulic cylinder 21 is installed on the worktable 1 through the hydraulic cylinder installation frame 22. The first guide rail 23 is disposed on top of the worktable 1. The movable frame 24 is installed on the first guide rail 23. The first lettering device 3 comprises a connecting frame 31, a Y-axis servo motor 32, a screw rod 33, and a second guide rail 34. The Y-axis servo motor 32, the screw rod 33, and the second guide rail 34 are all installed on the movable frame 24. The Y-axis servo motor 32 brings the screw rod 33 to turn. One end of the connecting frame 31 is installed on the second guide rail 34 to slide along the Y-axis. Another end of the connecting frame 31 is threadedly connected with the screw rod 33. The connecting frame 31 is provided with an outer mold 62 of a concave mold configuration. The outer mold 62 is movable along the Y-axis. The second lettering device 4 comprises a rotatory disk seat 41, a Z-axis servo motor 42, and a bearing 43. The bearing 43 is installed on the worktable 1. A circumferential surface of the rotatory disk seat 41 is provided with an inner mold 61 of a convex mold configuration. The rotatory disk seat 41 is installed in the bearing 43. The Z-axis servo motor 42 is disposed at the bottom of the worktable 1 and brings the inner mold 61 to turn on the bearing 43 with the Z-axis as the axis. The rotatory disk seat 41 is adapted to receive a cask 5. The outer mold 62 is moved linearly along the X-axis through a push rod of the hydraulic cylinder 21 and corresponds in position to the inner mold 61 (they are at the same level). The outer mold 62 is located at the outer side of the cask 5. The inner mold 61 is located at the inner side of the cask 5. When the outer mold 62 is moved linearly along the X-axis through the push rod of the hydraulic cylinder 21, the outer mold 62 on the connecting frame 31 is moved linearly along the X-axis, such that the outer mold 62 cooperates with the inner mold 61 to emboss the side wall of the cask 5.

The apparatus of the present invention can be used to emboss a full label on a beer barrel. After the beer barrel is stretched and welded, the process of lettering is performed. This can avoid a waste of semi-finished products if the process of lettering is performed before stretch forming and welding and the stretch forming and welding cause defective products. Thus, the manufacture cost and time of products can be decreased. Through the control of the servo motors, the outer mold 62 and the inner mold 61 can be moved precisely.

As shown in FIG. 3 to FIG. 6, the inner mold 61 and the outer mold 62 each comprise at least one matrix 63. The matrix 63 of the inner mold 61 and the matrix 63 of the outer mold 62 are matched with each other to form a matrix assembly for lettering a single letter. The circumferential surface of the rotatory disk seat 41 and a Y-axis surface of the connecting frame 31 are each formed with at least one dovetail recess 44, 36 having the same size. The matrix 63 of the inner mold 61 and the matrix 63 of the outer mold 62 have the same size. The back of the matrix 63 of the inner mold 61 and the back of the matrix 63 of the outer mold 62 are engaged in the dovetail recesses 44, 36, such that the matrix 63 of the inner mold 61 and the matrix 63 of the outer mold 62 are installed on the circumferential surface of the rotatory disk seat 41 and the Y-axis surface of the connecting frame 31, respectively. To make an assumption, the operator intends to emboss a label "ABCD". The traditional inner mold 61 and the outer mold 62 are designed to be an integral matrix carved with the word "ABCD". When another label "EFCD" is required, it is necessary to replace with a new matrix. In the present invention, the matrix assemblies for the labels "ABCD" and "EFCD" are divided into four letter matrix assembles "A", "B", "C", "D" as well as "E", "F", "C", "D". Only the letter matrixes "A", "B" need to be replaced with "E", "F" (installed in the corresponding dovetail recesses 44, 36). The letter matrixes "C", "D" are remained. The matrix assembly "C", "D" may be exchanged for another label "ACBD" instead of the label "EFCD". Based on the aforesaid operation, the order of "A", "B", "C", "D" is changed to "A", "C", "B", "D", namely, the matrixes "A", "C", "B" are installed in the corresponding dovetail recesses 44, 36. The present invention achieves the versatility and interchangeability of matrixes and saves the time to exchange the molds. There is no need to manufacture various letter molds for different labels so as to save the cost and time of manufacturing molds. The matrix 63 of the connecting frame 31 is moved along the X-axis toward the matrix 63 of the rotatory disk seat 41 to complete the embossing of a single matrix assembly. When the X-axis is aligned with the diameter of the rotatory disk seat 41, the matrix 63 of the connecting frame 31 and the matrix 63 of the rotatory disk seat 41 emboss normally. This structure can emboss a single letter of a label.

As shown in FIG. 1 to FIG. 6 and FIG. 14, a lettering method for a beer barrel of the present invention comprises the following steps of:

1). installing and arranging multiple pairs of matrix assemblies on a Y-axis surface of a connecting frame and a circumferential surface of a rotatory disk seat, each pair of the matrix assembly forming a letter of a label; in the step 1, if the letters and the order of the matrix assemblies in use are the same as the previous installed matrix assemblies, the previous installed matrix assemblies are remained so as to attain the versatility and interchangeability of the matrixes. This saves the time to exchange the molds. There is no need to manufacture various letter molds for different labels so as to save the cost and time of manufacturing molds.

2). placing a cask which has been stretched and welded on the rotatory disk seat 41, enabling an inner side of the cask to correspond in position to matrixes 63 of convex mold configurations of the matrix assemblies and an outer side of the cask to correspond in position to matrixes 63 of concave mold configurations of the matrix assemblies, wherein the connecting frame is moved along the X-axis relative to the rotatory disk seat 41 to a embossing position. At this time, the matrix 63 of the first concave mold configuration and the matrix 63 of the first convex mold configuration are at the embossing position. (The embossing position: when the X-axis is aligned with the diameter of the rotatory disk seat, the matrix 63 of the connecting frame 31 and the matrix 63 of the rotatory disk seat 41 can emboss normally at the embossing position.)

3). moving the connecting frame 31 along the X-axis for the matrix 63 of the first concave configuration to get contact with the side wall of the cask and mate with the matrix 63 of the first convex mold configuration to emboss the first letter of the label, and then moving the connecting frame 31 reversely along the X-axis for the matrix 63 of the first concave configuration to disengage from the matrix 63 of the first convex mold configuration.

4). after disengagement, moving the connecting frame 31 along the Y-axis for the matrix of the next concave mold configuration to be moved to the embossing position. After embossing, the side wall of the cask is still engaged with the first matrix assembly. When the matrix of the concave mold configuration is moved along the X-axis to disengage from the side wall of the cask, the side wall of the cask is still engaged on the matrix of the convex mold configuration. The rotatory disk seat 41 brings the cask 5 to rotate along the Z-axis for the cask 5 and the matrix of the next convex mold configuration to be rotated to the embossing position. The rotatory disk can be used for different sizes of casks. There is no need to provide multiple rotatory disks. Thus, the cost to manufacture the apparatus for lettering on the beer barrel is lowered. Through the step 3, the process of embossing can be performed.

5). embossing the other letters of the label to complete the embossing of the label through the step 4.

The method of the present invention decreases the process and enhances the interchangeability of the matrixes so as to lower the manufacture cost and time of the molds. The operation is convenient.

As shown in FIG. 8 to FIG. 13, FIG. 15 and FIG. 16, a horizontal-type lettering apparatus for a beer barrel in accordance with a second embodiment of the present invention comprises a worktable 1, a hydraulic push device 2 installed on the worktable 1, a first lettering device 3, and a second lettering device 4. The hydraulic push device 2 can be controlled separately. The second lettering device 4 and the cask are disposed horizontally (Z-axis). The first lettering device 3 is disposed back and forth (Y-axis) and located above the second lettering device 4. The hydraulic push device 2 is disposed up and down (Y-axis). The second embodiment is substantially similar to the first embodiment except the position of configuration. Besides, the second embodiment is further provided with other functions.

Figure 8:
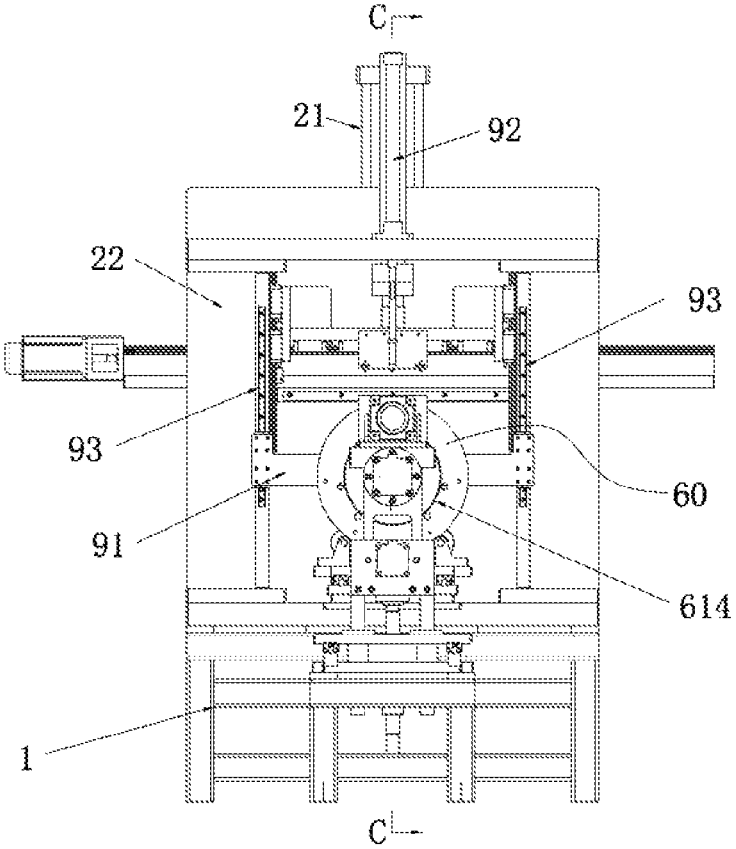
FIG. 8 is a right view of the horizontal-type lettering apparatus for a beer barrel of the present invention.
Figure 9:
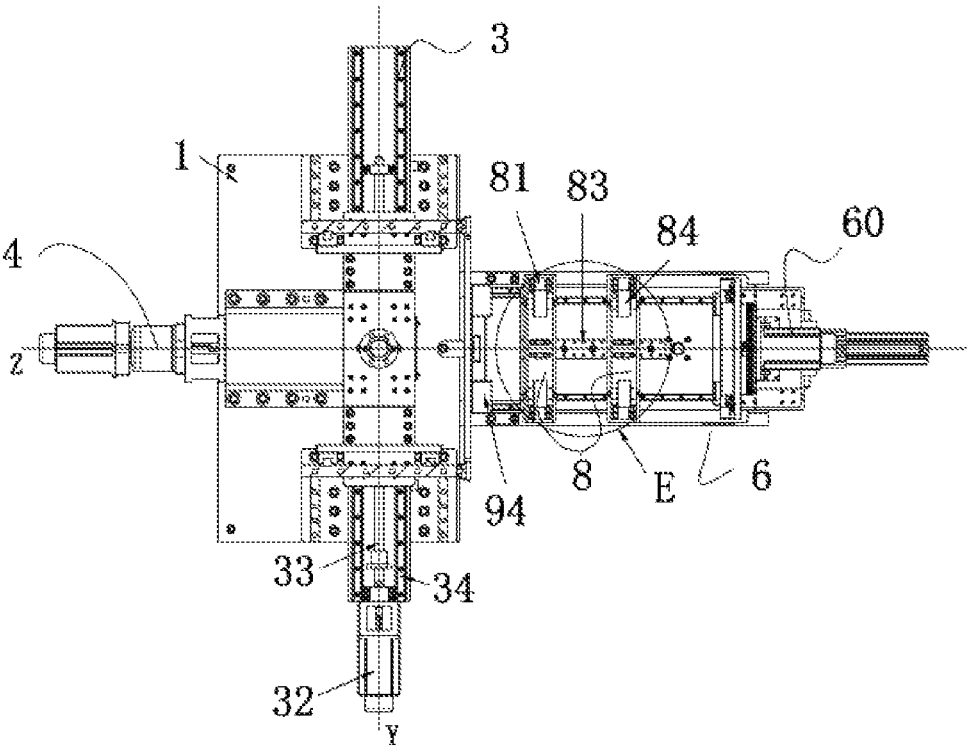
FIG. 9 is a top view of the horizontal-type lettering apparatus for a beer barrel of the present invention.
Figure 10:
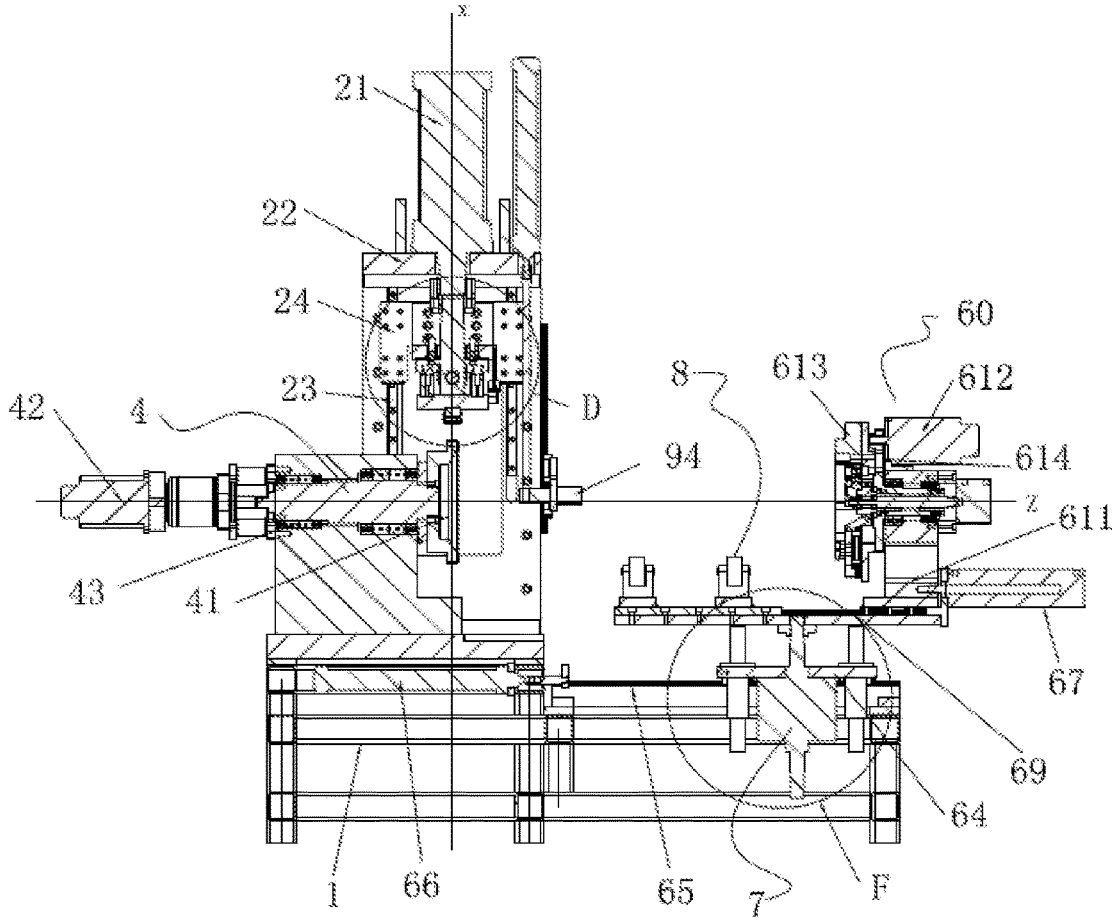
FIG. 10 is a sectional view taken along line C-C of FIG. 8.
Figure 11:
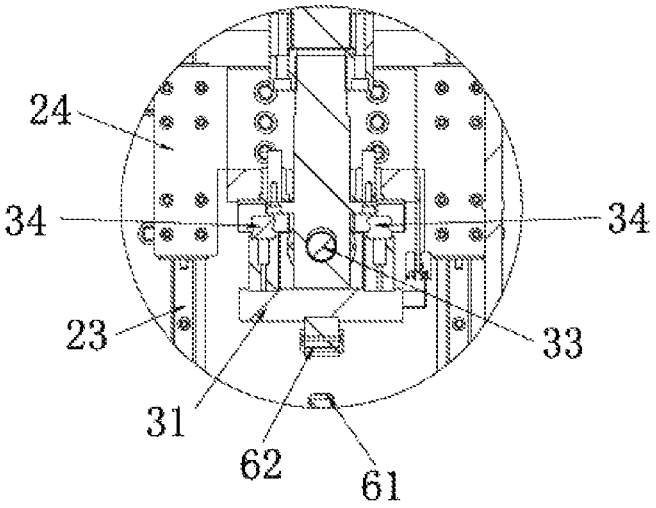
FIG. 11 is an enlarged view of circle D of FIG. 10.

As shown in FIG. 8, FIG. 9 and FIG. 10, the second embodiment is provided with a cask drive mechanism 6. The cask drive mechanism 6 comprises a three-detent positioning clamp 60, a third guide rail 65, a fourth guide rail 69, a placement board 64, a Z-axis cylinder 66, a first cylinder 67, and a lift mechanism 7. The three-detent positioning clamp 60 is adapted to secure one end of the cask 5 and rotate. The third guide rail 65 and the fourth guide rail 69 are disposed on the worktable 1 and the lift mechanism 7 respectively and parallel to the Z-axis. The placement board 64 is mounted on the third guide rail 65 and moved linearly along the third guide rail 65 through the Z-axis cylinder 66. The three-detent positioning clamp 60 is mounted on the fourth guide rail 69 and moved linearly along the fourth guide rail 69 through the first cylinder 67, enabling the cask 5 to be moved to an embossing position.

As shown in FIG. 10, the three-detent positioning clamp 60 comprises an engaging disk installation frame 611, an engaging disk servo motor 612, and a three-detent engaging disk 613. The three-detent engaging disk 613 and the rotatory disk seat 41 are coaxial. The three-detent engaging disk 613 may be a pneumatic structure. The three-detent engaging disk 613 is installed on the fourth guide rail 69 through the engaging disk installation frame 611 to be rotated axially. The back of the three-detent engaging disk 613 is provided with a gear 614. The three-detent engaging disk 613 and the gear 614 are coaxial. The engaging disk servo motor 612 is fixedly installed on the engaging disk installation frame 611. The spindle of the engaging disk servo motor 612 is provided with an axial small gear. The small gear meshes with the gear 614, enabling the cask 5 to be independently rotated relative to the rotatory disk seat 41, such that the power of the cask 5 can be controlled independently.

Figure 13:
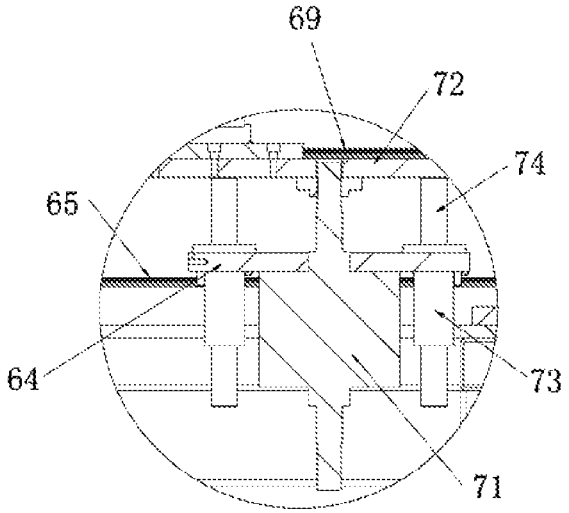
FIG. 13 is an enlarged view of circle D of FIG. 10.
Figure 14:
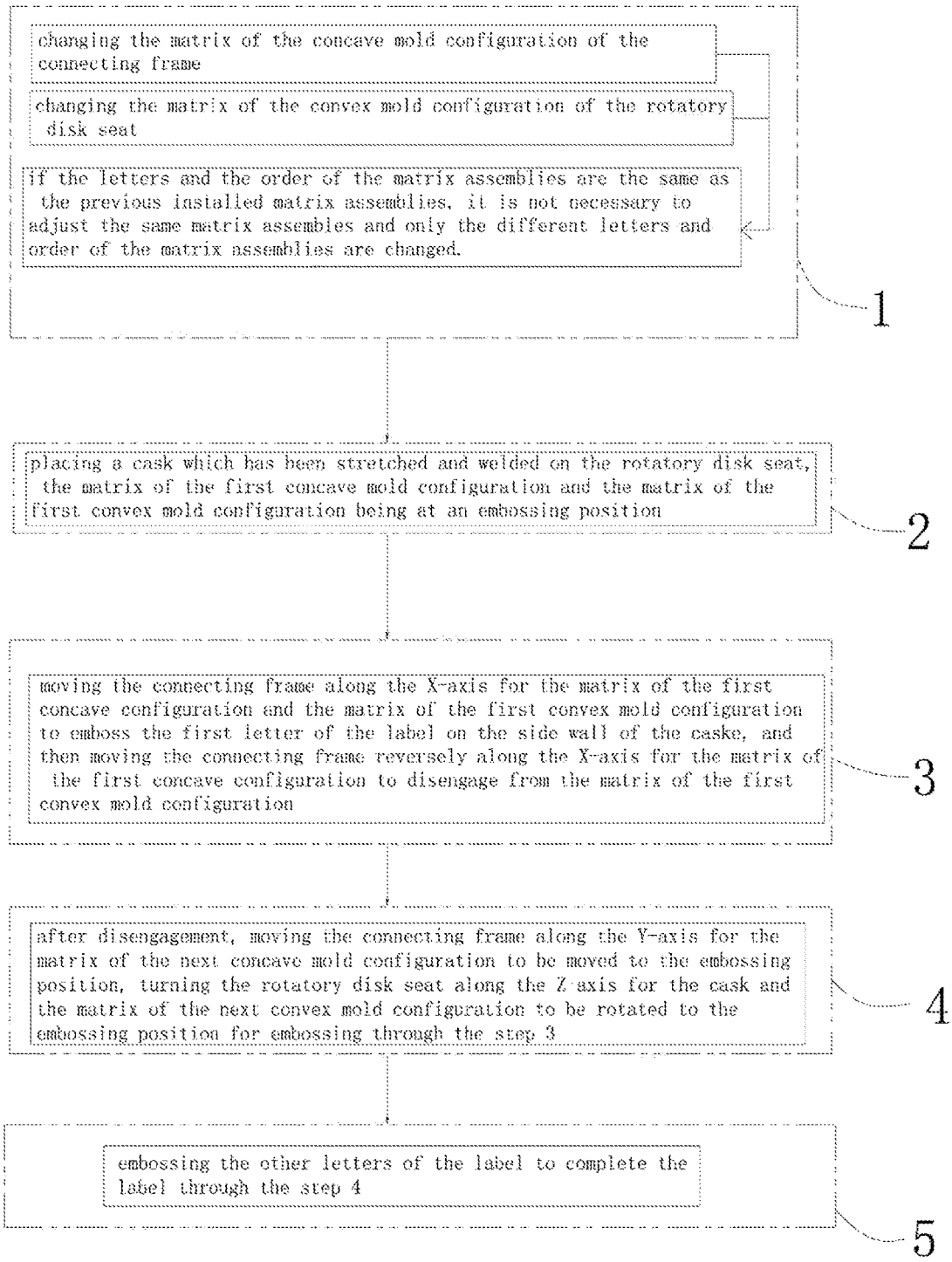
FIG. 14 is a flow chart of a lettering method for a beer barrel of the present invention.

As shown in FIG. 10 and FIG. 13, the lift mechanism 7 comprises a lift cylinder 71, a lift board 72, a sleeve rod 73, and a guide rod 74. The sleeve rod 73 and the guide rod 74 are disposed at the periphery of the placement board 64. The lift cylinder 71 and the sleeve rod 73 are fixedly installed on the placement board 64. The guide rod 74 is slidably inserted in the sleeve rod 73. The top of the guide rod 74 is fixedly connected to the lift board 72 to enhance the lift function of the lift board 72. The lift rod of the lift cylinder 71 brings the lift board 72 to ascend and descend. The fourth guide rail 69 is installed on the lift board 72. The three-detent engaging disk 613 is disposed on the fourth guide rail 69 through the engaging disk installation frame 611, so that the cask 5 positioned by the three-detent engaging disk 613 can be controlled to ascend and descend. After embossing, the matrix 63 of the concave mold configuration is returned through the hydraulic cylinder. The side wall of the cask 5 is embossed on the matrix of the convex mold configuration and engaged with each other. Through the cask 5 to be moved upward, the cask 5 and the matrix of the convex mold configuration of the rotatory disk seat 41 are separated from each other, such that the rotatory disk seat 41 and the cask 5 can be rotated independently.

Figure 12:
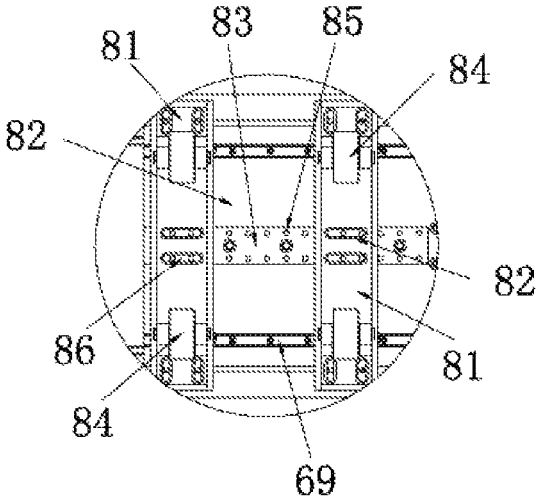
FIG. 12 is an enlarged view of circle E of FIG. 9.

As shown in FIG. 9, FIG. 10, and FIG. 12, this embodiment further comprises a cask placement mechanism 8. The cask placement mechanism 8 comprises two support seat assemblies. Each support seat assembly comprises a slide seat 81, an adjustment mechanism 82, a positioning board 83 installed on the lift board 72, and a pair of rollers 84 disposed symmetrically at left and right sides of the slide seat 81. Outer circumferential surfaces of the rollers 84 are in contact with the outer wall of the cask 5 to support the cask 5 in a rolling manner so as to decrease friction therebetween. The left and right sides of the slide seat 81 are installed on the fourth guide rail 69 and slides linearly along the fourth guide rail 69. The positioning board 83 is located on top of the slide seat 81 and has a plurality of adjustment holes 85 arranged along Z-axis. The slide seat 81 and the adjustment holes 85 are connected through the adjustment mechanism 82 for different lengths of casks 5.

The slide seat 81 has a slotted hole 86. The slotted hole 86 and the adjustment holes are fixedly connected through the adjustment mechanism 82.

As shown in FIG. 9, this embodiment further comprises a tightening mechanism 9 disposed on top of the cask placement mechanism 8. The tightening mechanism 9 includes a slide block 91, a second cylinder 92, a fifth guide rail 93, and a pair of tightening blocks 94 disposed symmetrically at left and right sides of the slide block 91. The fifth guide rail 93 and the second cylinder 92 are installed on the hydraulic cylinder installation frame 22. The fifth guide rail 93 is parallel to the X-axis. The slide block 91 is installed on the fifth guide rail 93 and pushed by the second cylinder 92 to slide linearly along the fifth guide rail 93. One end of the cask 5 is engaged with the three-detent engaging disk 613 and the other end of the cask 5 leans against the tightening block 94, so that the cask 5 and the three-detent engaging disk 613 are connected tightly, and the positioning can be more precise. The tightening block 94 leans against the middle of the cask to enhance the precision and to enhance the engaging effect of the three-detent engaging disk 613. The tightening block 94 is made of nylon for reducing scrapes on the side wall of the cask.

The apparatus of the present invention is provided with the procedure of embossing serial numbers. The serial numbers can be embossed on the casks in sequence. The serial numbers correspond to the matrixes of the apparatus. When the next cask is embossed, the corresponding matrixes are changed. For example, the first cask is embossed with the number of 20150703-001, and the next cask is embossed with the number of 20150703-002, and so on. Each cask has its own serial number. The operator just inputs the first serial number, and then the apparatus will emboss the serial numbers on the casks in order. It is very convenient for operation.

Figure 15:
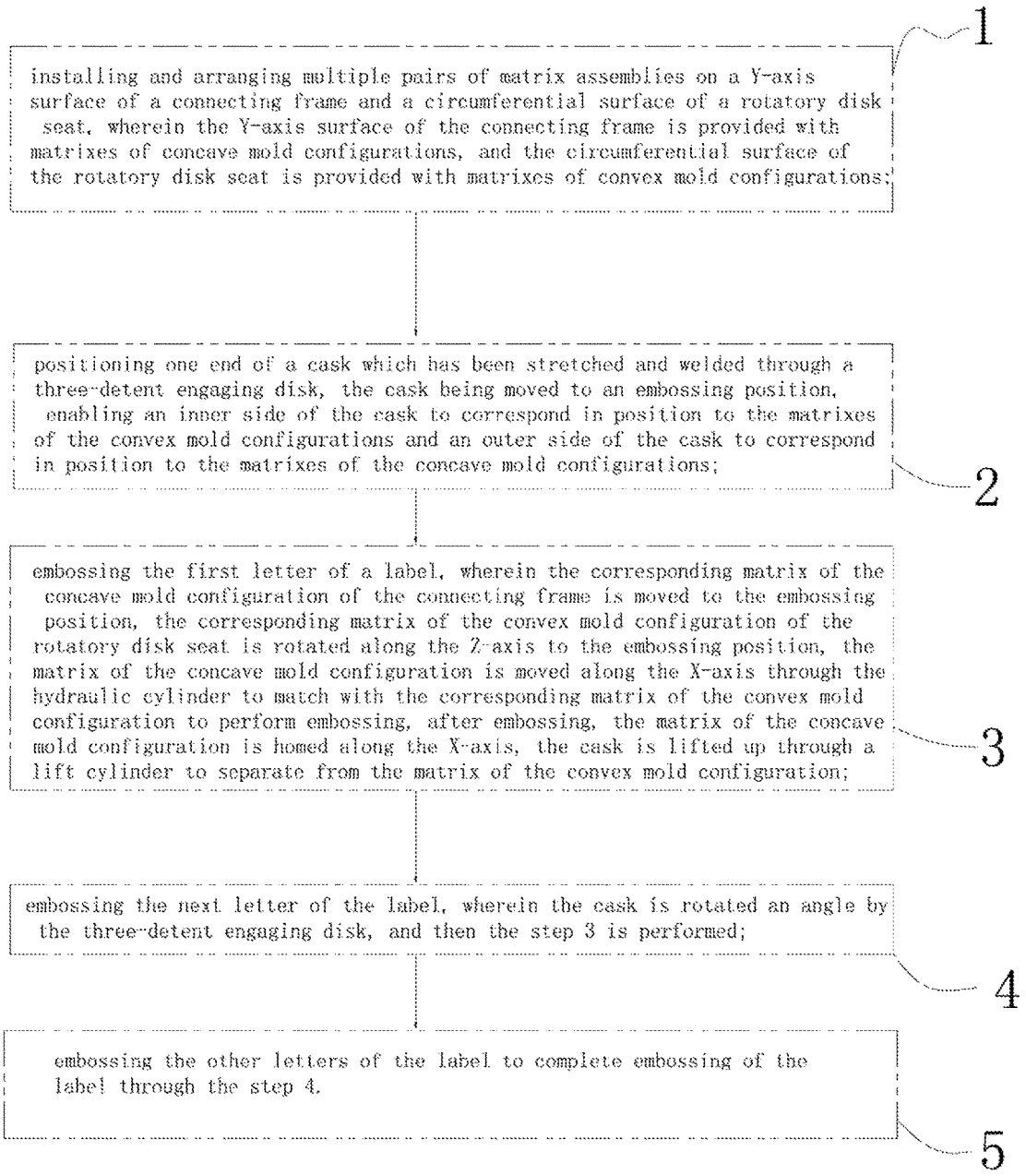
FIG. 15 is a flow chart of another lettering method for a beer barrel of the present invention.

As shown in FIG. 15, the method of the second embodiment of the present invention comprises the steps of:

1). installing and arranging multiple pairs of matrix assemblies on a Y-axis surface of a connecting frame and a circumferential surface of a rotatory disk seat, wherein the Y-axis surface of the connecting frame is provided with matrixes of concave mold configurations, and the circumferential surface of the rotatory disk seat is provided with matrixes of convex mold configurations;

2). placing a cask which has been stretched and welded on the rollers 84 transversely, wherein the tightening block 94 is moved to the middle of the cask, the first cylinder 6 brings the three-detent engaging disk 613 to move toward the cask 5 and get connect with the cask 5 and bring the cask 5 to move continuously, one axial end of the cask 5 holds against the three-detent engaging disk 613, the other end of the cask 5 holds against the tightening block 94, the cask 5 is clamped and positioned by the three-detent engaging disk 613, the tightening block 94 is moved upward, and the cask 5 is controlled by the Z-axis cylinder 66 and moved toward the rotatory disk seat 41 to the embossing position;

3). when the first letter of a label is embossed, the corresponding matrix of the concave mold configuration of the connecting frame 31 being moved to the embossing position, the corresponding matrix of the convex mold configuration of the rotatory disk seat being rotated along the Z-axis to the embossing position, the matrix of the concave mold configuration being moved along the X-axis through the hydraulic cylinder 21 to perform embossing, after embossing, the matrix of the concave mold configuration being homed along the X-axis, the cask 5 being lifted up through the lift cylinder to separate from the matrix of the convex mold configuration;

4). when the next letter of the label is embossed, the three-detent engaging disk being separately controlled to rotate the cask to a desired angle, and then performing the step 3; and 5). embossing the other letters of the label to complete the embossing of the label through the step 4.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A lettering apparatus for a beer barrel, comprising a worktable, a hydraulic push device installed on the worktable, a first lettering device, and a second lettering device; the second lettering device comprising a rotatory disk seat with the Z-axis as its axis, the rotatory disk seat being adapted to install a cask thereon, a circumferential surface of the rotatory disk seat being provided with an inner mold for lettering on an inner side of the cask, the first lettering device comprising a connecting frame, the connecting frame being movable linearly along the Y-axis, the connecting frame being provided with an outer mold for lettering on an outer side of the cask, the hydraulic push device controlling the outer mold of the connecting frame to move linearly along the X-axis for the outer mold and the inner mold to emboss on a side wall of the cask;

wherein the inner mold and the outer mold each comprise at least one matrix, the matrix of the inner mold and the matrix of the outer mold are matched with each other to form a matrix assembly for embossing a single letter; the matrixes of the outer mold and the inner mold are installed on a Y-axis surface of the connecting frame and the circumferential surface of the rotatory disk seat respectively, and the matrix of the connecting frame is moved along the X-axis toward the matrix of the rotatory disk seat to complete embossing of the matrix assembly.

2. The lettering apparatus for a beer barrel as claimed in claim 1, wherein the hydraulic push device comprises a hydraulic cylinder, a hydraulic cylinder installation frame, a first guide rail, and a movable frame; the hydraulic cylinder is installed on the worktable through the hydraulic cylinder installation frame, the first guide rail is disposed on top of the worktable, and the movable frame is installed on the first guide rail and moved linearly along the X-axis through a push rod of the hydraulic cylinder.

3. The lettering apparatus for a beer barrel as claimed in claim 2, wherein the first lettering device further comprises a Y-axis servo motor, a screw rod, and a second guide rail; the Y-axis servo motor, the screw rod, and the second guide rail are all installed on the movable frame, the Y-axis servo motor brings the screw rod to turn, one end of the connecting frame is installed on the second guide rail to slide along the Y-axis, and another end of the connecting frame is threadedly connected with the screw rod.

4. The lettering apparatus for a beer barrel as claimed in claim 3, wherein the second lettering device further comprises a Z-axis servo motor and a bearing; the bearing is installed on the worktable, the rotatory disk seat is installed in the bearing, and the Z-axis servo motor is disposed at a bottom of the worktable and brings the rotatory disk seat to turn on the bearing with the Z-axis as its axis.

5. The lettering apparatus for a beer barrel as claimed in claim 4, wherein the inner mold and the outer mold each comprise at least one matrix, the matrix of the inner mold and the matrix of the outer mold are matched with each other to form a matrix assembly for embossing a single letter; the matrixes of the outer mold and the inner mold are installed on a Y-axis surface of the connecting frame and the circumferential surface of the rotatory disk seat respectively, and the matrix of the connecting frame is moved along the X-axis toward the matrix of the rotatory disk seat to complete embossing of the matrix assembly.

6. The lettering apparatus for a beer barrel as claimed in claim 5, wherein the circumferential surface of the rotatory disk seat and the Y-axis surface of the connecting frame are each formed with at least one dovetail recess having the same size, the matrix of the inner mold and the matrix of the outer mold have the same size, a back of the matrix of the inner mold and a back of the matrix of the outer mold are engaged in the dovetail recesses of the rotatory disk seat and the connecting frame, such that the matrix of the inner mold and the matrix of the outer mold are installed on the circumferential surface of the rotatory disk seat and the Y-axis surface of the connecting frame, respectively.

7. The lettering apparatus for a beer barrel as claimed in claim 5, wherein when the X-axis is aligned with the diameter of the rotatory disk seat, the matrix of the connecting frame and the matrix of the rotatory disk seat are to emboss on the cask.

8. The lettering apparatus for a beer barrel as claimed in claim 1, wherein the circumferential surface of the rotatory disk seat and the Y-axis surface of the connecting frame are each formed with at least one dovetail recess having the same size, the matrix of the inner mold and the matrix of the outer mold have the same size, a back of the matrix of the inner mold and a back of the matrix of the outer mold are engaged in the dovetail recesses of the rotatory disk seat and the connecting frame, such that the matrix of the inner mold and the matrix of the outer mold are installed on the circumferential surface of the rotatory disk seat and the Y-axis surface of the connecting frame, respectively.

9. The lettering apparatus for a beer barrel as claimed in claim 1, wherein when the X-axis is aligned with the diameter of the rotatory disk seat, the matrix of the connecting frame and the matrix of the rotatory disk seat are to emboss on the cask.

10. The lettering apparatus for a beer barrel as claimed in claim 9, further comprising a cask drive mechanism; the cask drive mechanism comprising a three-detent positioning clamp used to position and control the cask to rotate axially and independently, the three-detent positioning clamp and the rotatory disk seat being coaxial, the three-detent positioning clamp being movable axially.

11. The lettering apparatus for a beer barrel as claimed in claim 10, wherein the cask drive mechanism further comprises a third guide rail, a fourth guide rail, a placement board, a Z-axis cylinder, a first cylinder, and a lift mechanism; the third guide rail and the fourth guide rail are disposed on the worktable and the lift mechanism respectively and parallel to the Z-axis, the placement board is mounted on the third guide rail and moved linearly along the third guide rail through the Z-axis cylinder, the three-detent positioning clamp is mounted on the fourth guide rail and moved linearly along the fourth guide rail through the first cylinder; and the lift mechanism is installed on the placement board to bring the three-detent positioning clamp to ascend and descend.

12. The lettering apparatus for a beer barrel as claimed in claim 11, wherein the three-detent positioning clamp comprises an engaging disk installation frame, an engaging disk servo motor, and a three-detent engaging disk; the three-detent engaging disk and the rotatory disk seat are coaxial, the three-detent engaging disk is installed on the fourth guide rail through the engaging disk installation frame to be rotated axially, a back of the three-detent engaging disk is provided with a gear, the three-detent engaging disk and the gear are coaxial, the engaging disk servo motor is fixedly installed on the engaging disk installation frame and meshes with the gear, enabling the cask to be independently rotated relative to the rotatory disk seat, and the first cylinder controls the engaging disk installation frame to slide along the fourth guide rail.

13. The lettering apparatus for a beer barrel as claimed in claim 12, further comprising a tightening mechanism, the tightening mechanism comprising a slide block, a second cylinder, a fifth guide rail, and a pair of tightening blocks disposed symmetrically at left and right sides of the slide block; the fifth guide rail and the second cylinder being installed on the hydraulic cylinder installation frame, the fifth guide rail being parallel to the X-axis, the slide block being installed on the fifth guide rail and pushed by the second cylinder to slide linearly along the fifth guide rail; one end of the cask being engaged with the three-detent engaging disk, and another end of the cask leaning against the tightening block.

14. The lettering apparatus for a beer barrel as claimed in claim 13, wherein the tightening block leans against a middle portion of the cask.

15. The lettering apparatus for a beer barrel as claimed in claim 14, wherein the tightening block is made of nylon.

16. The lettering apparatus for a beer barrel as claimed in claim 11, wherein the lift mechanism comprises a lift cylinder, a lift board, a sleeve rod, and a guide rod; the sleeve rod and the guide rod are disposed at the periphery of the placement board, the lift cylinder and the sleeve rod are fixedly installed on the placement board, the guide rod is slidably inserted in the sleeve rod, a top of the guide rod is fixedly connected to the lift board, a lift rod of the lift cylinder brings the lift board to ascend and descend, and the fourth guide rail is installed on the lift board.

17. The lettering apparatus for a beer barrel as claimed in claim 16, further comprising a cask placement mechanism; the cask placement mechanism comprising two support seat assemblies, each support seat assembly comprising a slide seat, an adjustment mechanism, a positioning board installed on the lift board, and a pair of rollers disposed symmetrically at left and right sides of the slide seat; outer circumferential surfaces of the rollers are in contact with the outer side of the cask; the left and right sides of the slide seat are installed on the fourth guide rail and slides linearly along the fourth guide rail, the positioning board is located on top of the slide seat and has a plurality of adjustment holes arranged along Z-axis, and the slide seat and the adjustment holes are connected through the adjustment mechanism.

18. The lettering apparatus for a beer barrel as claimed in claim 11, further comprising a cask placement mechanism; the cask placement mechanism comprising two support seat assemblies, each support seat assembly comprising a slide seat, an adjustment mechanism, a positioning board installed on the lift board, and a pair of rollers disposed symmetrically at left and right sides of the slide seat; outer circumferential surfaces of the rollers are in contact with the outer side of the cask; the left and right sides of the slide seat are installed on the fourth guide rail and slides linearly along the fourth guide rail, the positioning board is located on top of the slide seat and has a plurality of adjustment holes arranged along Z-axis, and the slide seat and the adjustment holes are connected through the adjustment mechanism.

19. The lettering apparatus for a beer barrel as claimed in claim 12, further comprising a cask placement mechanism; the cask placement mechanism comprising two support seat assemblies, each support seat assembly comprising a slide seat, an adjustment mechanism, a positioning board installed on the lift board, and a pair of rollers disposed symmetrically at left and right sides of the slide seat; outer circumferential surfaces of the rollers are in contact with the outer side of the cask; the left and right sides of the slide seat are installed on the fourth guide rail and slides linearly along the fourth guide rail, the positioning board is located on top of the slide seat and has a plurality of adjustment holes arranged along Z-axis, and the slide seat and the adjustment holes are connected through the adjustment mechanism.

20. The lettering apparatus for a beer barrel as claimed in claim 10, wherein the slide seat has a slotted hole, and the slotted hole and the adjustment holes are fixedly connected through the adjustment mechanism.

* * * * *